US009293120B2

(12) United States Patent
West

(10) Patent No.: US 9,293,120 B2
(45) Date of Patent: Mar. 22, 2016

(54) ADJUSTABLE CAPO DEVICE FOR FRETTED STRINGED INSTRUMENTS

(71) Applicant: Jonathan Charles Devlin West, Chesham (GB)

(72) Inventor: Jonathan Charles Devlin West, Chesham (GB)

( * ) Notice: Subject to any disclaimer, the term of this patent is extended or adjusted under 35 U.S.C. 154(b) by 0 days.

(21) Appl. No.: 14/497,374

(22) Filed: Sep. 26, 2014

(65) Prior Publication Data

US 2015/0128783 A1 May 14, 2015

(51) Int. Cl.
*G10D 3/04* (2006.01)
*G10D 3/00* (2006.01)

(52) U.S. Cl.
CPC . *G10D 3/043* (2013.01); *G10D 3/04* (2013.01)

(58) Field of Classification Search
CPC ..... G10D 3/04; G10D 3/043
USPC ..... 84/318
See application file for complete search history.

(56) References Cited

U.S. PATENT DOCUMENTS

| | | | | | |
|---|---|---|---|---|---|
| 3,227,028 | A * | 1/1966 | Simms | G10D 1/10 | 84/318 |
| 5,284,077 | A * | 2/1994 | Ellis | G10D 3/043 | 84/318 |
| 6,005,174 | A * | 12/1999 | Regen | G10D 3/043 | 84/318 |
| 6,013,868 | A * | 1/2000 | Sims | G10D 3/043 | 84/318 |
| 6,998,526 | B1 * | 2/2006 | Sims | G10D 3/043 | 84/318 |
| 7,956,263 | B1 * | 6/2011 | Volk, Jr. | G10D 3/043 | 84/318 |
| 8,759,651 | B2 * | 6/2014 | Kosharek | G10D 3/14 | 84/297 R |
| 8,779,261 | B2 * | 7/2014 | Dunlop | | 84/318 |
| 2005/0087056 | A1 * | 4/2005 | Zager | G10D 3/043 | 84/318 |
| 2007/0175312 | A1 * | 8/2007 | Walworth | G10D 3/043 | 84/318 |
| 2012/0255419 | A1 * | 10/2012 | Lucas | G10D 3/043 | 84/318 |
| 2013/0192442 | A1 * | 8/2013 | Ruck | G10D 3/043 | 84/318 |
| 2013/0276613 | A1 * | 10/2013 | Kosharek | G10D 3/043 | 84/297 R |
| 2015/0255049 | A1 * | 9/2015 | McClary | G10D 3/043 | 84/318 |

* cited by examiner

*Primary Examiner* — David Warren
*Assistant Examiner* — Christina Schreiber

(57) ABSTRACT

An inventive set of small devices ('capo elements') to mechanically secure a string or strings of a guitar or other fretted stringed instrument at selected fret positions in order to selectively vary the string vibrational length and pitch when the string is plucked. This plurality of capo elements comprises a series of individual rectangular shaped blocks having formed on their upper portions a groove running parallel to the strings so shaped as to secure the string using an interference fit, thus preventing vibration at the distal end of the string and changing its pitch when plucked. Said capo elements feature a lip in the underside of the proximal portion of each capo element, so shaped as to overhang the raised fret, to ensure correct positioning of the capo element, and to secure the string at the same length as would otherwise have been achieved by fretting the string in the regular manner. Said capo elements have an adhesive bottom surface to secure them temporarily to the instrument fretboard. Said capo elements are made of a hard plastic so as not to dampen any vibration and deaden the tone, and are so sized as to enable them to be used adjacently on the same fret without impeding the movement of the musician's fretting hand. A plurality of capo elements are provided, one for each of the strings, though the musician has the option to leave desired strings unaltered without fitting capo elements. After use, the elements are removed manually and should not mark the fretboard.

18 Claims, 1 Drawing Sheet

ADJUSTABLE CAPO DEVICE FOR FRETTED STRINGED INSTRUMENTS

FIELD OF INVENTION

This invention relates generally to stringed instruments, and more especially to guitars and fretted instruments.

BACKGROUND OF THE INVENTION

In fretted stringed musical instruments, one or more strings are stretched under tension across the main body of the instrument, which amplifies the sound of the vibrating string. One end of the string is anchored at one side of the main body (often referred to as the 'bridge'), and the other end is anchored at the end of the neck furthest from the main body (often referred to as the 'nut'). A series of ridges (or 'frets') running transverse to the neck (the 'fretboard') are positioned at various intervals, underneath the strings. The strings do not touch the frets, even during vibration.

The pitch of a plucked string is determined by the relationship of the tension of the string, its mass per unit length (which is a function of the string's diameter), and the length of the string available for vibration (effective length). This length is the distance between the bridge and the nut.

On fretted stringed musical instruments, one of the player's hands is used for plucking or striking the strings while the other one may press upon one or more strings of the instrument with one or more fingers to cause the string to engage the frets along the neck of the guitar or other musical instrument. This procedure reduces the effective string length to the distance between the bridge and the fret, allowing the musician to change the pitch as called for by the musical score.

Stringed instruments are normally played in a standard tuning; when no strings are depressed upon frets (termed 'open' strings, played without fingering), they are under defined tension to produce a standard series of pitches. A device called a 'capo' (or 'capotasto') is often used to mechanically depress the strings onto a fret, effectively shortening the length of the strings. Most capos depress all strings, though there is occasionally a need for only a selection of stings to be depressed. This makes a greater variety of sounds available to the musician.

There are a great number of patents issued for innovative capo designs, though fewer for capos that allow only a selection of strings to be depressed (e.g. U.S. Pat. No. 5,623,110, NL8900025). One major drawback of such designs is that although they allow a selection of strings to be depressed, the capo is only fitted across one fret, and so it is impossible to depress different strings at different frets without using multiple capos, which would impede playing. One capo design allows different strings to be depressed at different frets (GB2349010), but this would also impede the fretting hand as it moves across the device.

Further innovations have involved the use of a multitude of individual capo elements that depress only one string each, and can be positioned anywhere along the neck of the instrument (U.S. Pat. No. 6,998,526, CA2244647, CA2213187, U.S. Pat. No. 6,013,868, GB2393315, U.S. Pat. No. 5,056,397). These designs all focus on the mechanical means of depressing the string onto the fret, and all require the modification of the instrument itself, by requiring magnets within the instrument neck (U.S. Pat. No. 6,998,526, CA2244647, CA2213187, U.S. Pat. No. 6,013,868), mechanical fixings (GB2393315), or specially profiled frets (U.S. Pat. No. 5,056,397).

There remains a need for a means of mechanically altering the pitch of selected individual strings, at different positions along the instrument neck, which does not impede the fingering hand movement along the neck, and does not require any modification of the instrument itself.

DISCLOSURE OF INVENTION

The invention relates to a device for mechanically altering the pitch of selected individual strings of a fretted stringed musical instrument such as a guitar. This is accomplished by shortening one or more strings of the musical instrument to produce a pitch different than its usual unaltered frequency.

According to one embodiment, the mechanical devices, or fixed capo elements, of the invention which are the means to mechanically alter the pitch of a string, comprise a multitude of specially designed blocks placed upon the fretboard, abutting the appropriate fret to give the desired pitch. Each block has a groove formed into the top into which the string is wedged, thus preventing vibration. In the preferred embodiment, each capo element has a groove corresponding to the diameter of the specific string for which it is to be used. Each block is secured temporarily to the fretboard using an appropriate adhesive. The string is secured at that position until the capo element is removed. The capo elements can be placed at any point along the fretboard. To remove the capo element from the fretboard, it is pulled away and the string removed from its groove. In the preferred embodiment, the capo elements may be reapplied, though it may be that these elements are disposable, and a new set must be used every time the positions are changed.

It is an object of the subject invention to provide a device for mechanically altering the pitch of selected individual strings of a fretted stringed musical instrument such as a guitar.

It is another object of the subject invention to provide a mechanical device such that various lengths of a string of a stringed instrument can be fixed for different pitches.

It is still a further object of the subject invention to provide a mechanical device for each individual string of the instrument, and to provide a complete pitch selection for the strings of a fretted stringed instrument.

It is still another object of the subject invention to provide a mechanical device for varying string pitch of a fretted stringed instrument that is affordable, does not impede the musician's playing hand motion and does not require any modification to the instrument.

BRIEF DESCRIPTION OF DRAWINGS

For a more complete explanation of the present invention and the technical advantages thereof, reference is now made to the following description and the accompanying drawing in which.

BEST MODE FOR CARRYING OUT THE INVENTION

Figure 1:
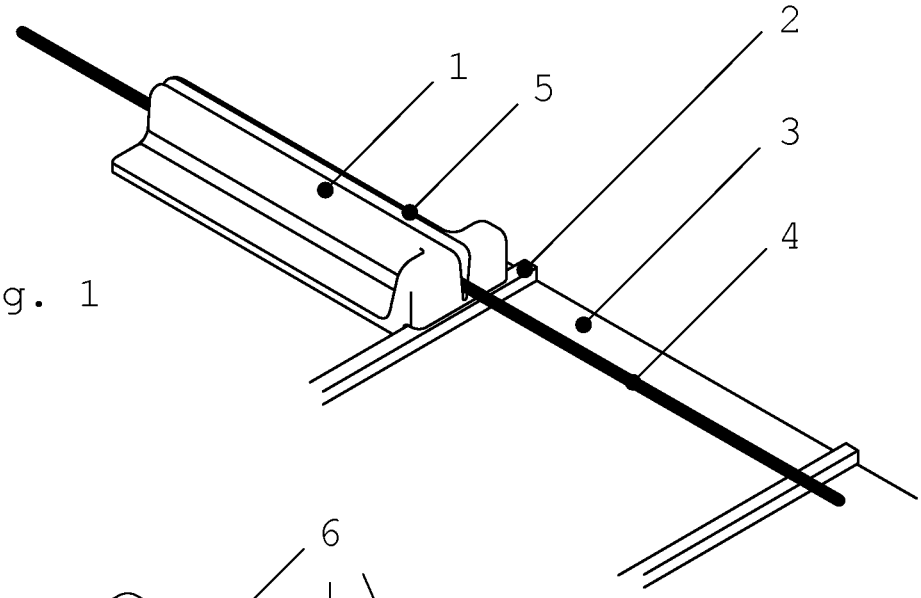
FIG. 1 shows an isometric projection of a single capo element of the present invention in the correct position abutting a fret, securing the string at the appropriate position.
Figure 2:
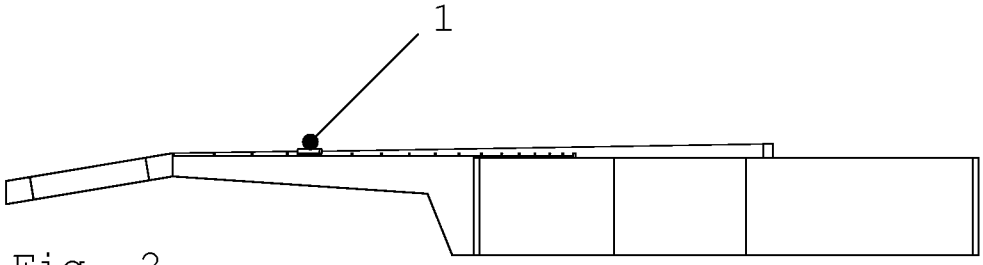
FIG. 2 shows a side view of a capo element in situ, placed on the fretboard of a guitar.
Figure 3:
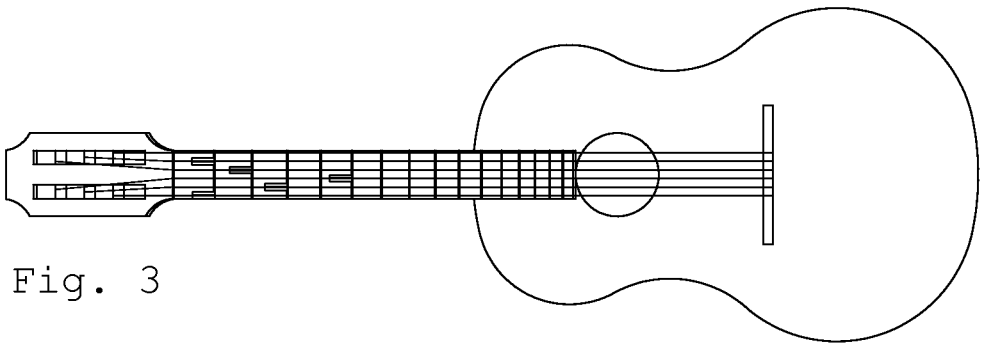
FIG. 3 shows a top view of multiple capo elements used at different frets on different strings.

Embodiments of the present invention and their technical advantages may be better understood by referring to FIGS. 1, 2 and 3.

FIG. 1 shows a capo element (1) in position, placed up against a fret (2) and stuck to the fretboard (3). A string (4) is placed into the groove on top of the capo element such that it is fixed and cannot vibrate at its distal end. Plucking/bowing this string will cause it to vibrate according to its new effective length, thus altering the pitch.

The capo element (1) is made of a hard plastic so as not to dampen any vibration and deaden the tone. The element has an adhesive base with minimal thickness, in order to transfer string vibrations through the fretboard and back to the instrument body.

The proximal portion of the capo element (1) is so shaped as to overhang the raised fret (2). This ensures correct positioning of the capo element, so trapping the string at the same length as would otherwise have been achieved by fretting the string in the regular manner. Thus the overhanging portion is located nearest the bridge with the remaining part of each capo element extending towards the nut.

The groove (5) in the top of each capo element is so shaped as to trap the string with friction alone. Different strings have different diameters, and so the groove (5) must be correctly sized to each string to create an interference fit, and not allow any movement of the string. As such, a different width groove is necessary for each string, particularly when used for acoustic guitars where the diameter difference is relatively large.

Each capo element (1) is wide enough to allow multiple elements to be used side by side on the same fret. Each capo element (1) has sufficient length to allow a strong adhesive fixing to the fretboard, but is short enough to be used further up the neck of the instrument where the frets are closer together.

Figure 1A:
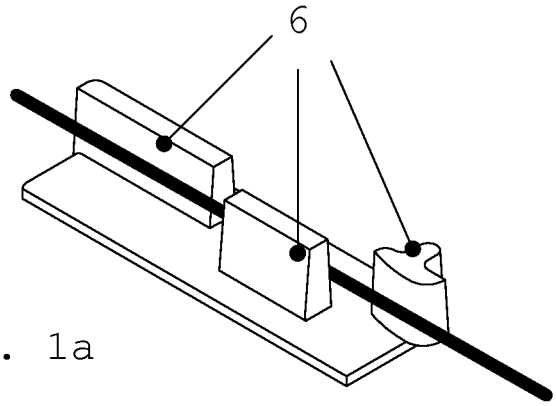
FIG. 1*a* shows an isometric projection of an alternative embodiment of the capo element.

FIG. 1*a* shows an alternative embodiment of the capo element whereby the string is secured by three small blades (6) arranged along the line of the string to replicate the groove (5). This replaces the narrow groove, which can be difficult to manufacture.

FIG. 2 shows a side view of a single capo element (1) in position at the fourth fret of a classical guitar. It must be noted that the element does not depress the string onto the fret (as with all other comparable patented variable capo inventions), instead it secures the string at its untouched height above the fret. This means that comparatively little force is needed to secure the string, and so the capo elements can be fixed in place with standard adhesive.

FIG. 3 shows a top view of a classical guitar with multiple capo elements securing different strings at different frets. This illustrates one advantage of the invention, namely that the musician is able to play chords that would otherwise be impossible due to the limits of reach and number of fingers. This advantage is further exploited when different tunings are used, allowing much greater intervals between strings than would otherwise be possible.

Strings for instruments are sold either singly or in sets. Sets of strings contain all the strings or a subgroup of strings used in the instrument. Strings are available in different weights from light to heavy and the gauges of the strings in a set of a given weight are often standard. Likewise the capo elements can be sold singly or in sets. When sold in a set, each element of the set may have grooves may have the same widths as the gauges of the corresponding standard string set. When sold singly, the width of the groove of a capo element should correspond to the standard gauge of a string.

Usually the capo elements will be marked in accordance with the strings they are to be used with. Thus, a set of capo elements may be marked for use with a given weight of strings for a given instrument. By way of example, a set of capo elements might be sold for use with light weight steel strings for an acoustic guitar and obviously the individual capo elements in that set will have grooves of a width corresponding to the gauges of the various light weight steel strings. When sold individually, the capo element may be marked with either the width of the groove (or the gauge of the string it is to be used with) or with both the type of string (e.g. the A string, the G string etc) and the weight of the string.

Instead of being marked, the capo elements may be coded, e.g. colour coded, or may be contained in packaging that is marked or coded.

Although the capo element so far described has a groove of fixed width, it is possible for the walls of the groove to move towards and away from each other to allow the easy fitting of the string within the groove and the subsequent clamping of the string. This can be achieved by making one of the sidewalls spring-loaded so that it is biased by a spring towards the other wall but can be moved away to release the string. A further alternative is for one wall to be moved by a screw thread towards or away from the other. A still further possibility is that the wall is movable by means of a slider and an associated sloping cam surface attached to the movable wall; the slider can be moved along the length of the cam surface in one direction the slider to cause the cam surface to urge the walls together while pushing the slider in the other direction allows the walls to be moved apart.

While a preferred embodiment has been shown and described, it will be understood that there is no intent to limit the invention by such disclosure, but rather it is intended to cover all modifications and alternate constructions falling within the spirit and the scope of the invention as defined in the appended claims.

I claim:

1. A capo element for use with a fretted stringed musical instrument having a fretboard surface containing a plurality of frets and at least one string stretched between two points to provide a vibrational length of string that overlies the plurality of frets on the fretboard surface, the capo element comprising:

a body having a top and a base, a groove in the top of the body, which groove is configured to accommodate and mechanically secure the string part of the way along its length, wherein the groove has a width that is configured to prevent vibration of the string beyond the capo element and selectively set the vibrational length of the string to be between one of the two points and the capo element, and an adhesive on the base of the body that can secure the capo element to the fretboard at the desired position.

2. A capo element as claimed in claim 1, wherein the body includes a cut-out in the base that is shaped to accommodate a raised fret, and wherein said groove has an end and wherein the cut-out is provided at the same position on the body as said end of the groove, the element being configured such that the end of the groove is located above the fret and is configured to trap the string at the same length as would otherwise have been achieved by fretting the string in the regular manner.

3. A capo element as claimed in claim 2, wherein the cut-out extends in a direction transversely to the groove.

4. A capo element as claimed in claim 1, wherein the strings of the musical instrument are spaced apart and wherein the body has a width that is less than half the spacing between the strings of the musical instrument, and is configured such that the separate capo elements may be provided side-by-side on adjacent strings.

5. A capo element as claimed in claim 4, wherein the width of the body is in the range of 3-5 mm.

6. A capo element as claimed in claim 1, wherein the frets are spaced apart and wherein the body has a length and wherein the length of the body is less than the smallest spacing between frets on the musical instrument.

7. A capo element as claimed in claim 6, wherein the of length of the body is in the range of 5-15 mm.

8. A capo element as claimed in claim 1, wherein the adhesive has a thickness that allows it to transfer string vibrations from the body through to the fretboard and back to the instrument body without noticeably dampening the overall string vibration.

9. A capo element as claimed in claim 8, wherein the thickness of the adhesive is less than 0.5 mm.

10. A capo element as claimed in claim 1, wherein the width of the groove is configured to accommodate a musical string of a standard gauge with an interference fit and prevent the string from vibrating audibly beyond the element.

11. A capo element as claimed in claim 1, wherein the groove is formed between three upwardly extending blades in said top of the body.

12. A capo element as claimed in claim 1, wherein the body is made of a hard plastic.

13. A capo element as claimed in claim 1, wherein the adhesive is a releasable adhesive having sufficient adherence to stick the body to the fretboard, and allowing it to be removed by hand without damaging the surface of the fretboard.

14. A capo element as claimed in claim 1, that is marked with, or coded in accordance with, the string or strings it is designed to be used with.

15. A set of capo elements as claimed in claim 1, wherein the elements of the set have grooves of different widths.

16. A set of capo elements as claimed in claim 1, wherein the set of capo elements is marked with, or coded in accordance with, a given weight of strings for a given instrument or is contained in packaging that is so marked or coded.

17. A method of changing the pitch of a string of a fretted stringed musical instrument by means of a capo element, the musical instrument having a fretboard surface containing a plurality of frets, wherein the string is stretched between two points to provide a vibrational length of string that overlies the plurality of frets on the fretboard surface, wherein the capo element comprises:

a body having a top and a base, a groove in the top of the body and an adhesive on the base of the body, and wherein the method comprises placing the string in the groove at a desired position and adhering the capo element to the underlying fretboard, wherein the string is accommodated and mechanically secured in the groove, to hold the string part of the way along its length, thereby preventing vibration of the string beyond the capo element and so selectively setting the vibrational length of the string to be between one of said two points and the capo element.

18. A method as claimed in claim 17, wherein the capo element is as claimed in claim 1.

* * * * *